US006614354B2

(12) United States Patent
Haines et al.

(10) Patent No.: US 6,614,354 B2
(45) Date of Patent: Sep. 2, 2003

(54) IN-GROUND PIPELINE MONITORING

(75) Inventors: Harvey Haines, Glen Ellyn, IL (US); Robert B. Francini, Columbus, OH (US)

(73) Assignee: Gas Research Institute, Des Plaines, IL (US)

( * ) Notice: Subject to any disclaimer, the term of this patent is extended or adjusted under 35 U.S.C. 154(b) by 126 days.

(21) Appl. No.: 09/798,692

(22) Filed: Mar. 2, 2001

(65) Prior Publication Data

US 2002/0149487 A1 Oct. 17, 2002

(51) Int. Cl.[7] ..... G08B 21/00

(52) U.S. Cl. ..... 340/605; 340/679; 340/550; 340/565; 340/665; 340/522; 73/40.5 R; 73/40.5 A; 73/49.1; 137/551

(58) Field of Search ..... 340/605, 670, 340/656.1, 540, 679, 522, 550, 541, 565, 665; 73/40.5 R, 49.2, 49.1, 40.5 A, 596; 702/51, 9, 41, 42; 367/93; 137/552, 551

(56) References Cited

U.S. PATENT DOCUMENTS

| | | | | | |
|---|---|---|---|---|---|
| 4,013,905 | A | * | 3/1977 | Breneman et al. | 310/336 |
| 4,600,356 | A | * | 7/1986 | Bridges et al. | 414/694 |
| 4,678,621 | A | | 7/1987 | Callaghan et al. | 376/245 |
| 5,104,391 | A | * | 4/1992 | Ingle et al. | 606/11 |
| 5,127,267 | A | * | 7/1992 | Huebler et al. | 73/584 |
| 5,416,724 | A | * | 5/1995 | Savic | 702/51 |
| 5,457,995 | A | * | 10/1995 | Staton et al. | 73/596 |
| 5,623,421 | A | * | 4/1997 | Savic | 702/51 |
| 5,675,506 | A | | 10/1997 | Savic | 702/51 |
| 6,138,512 | A | * | 10/2000 | Roberts et al. | 73/570 |
| 6,155,292 | A | * | 12/2000 | Kurata | 137/552 |
| 6,216,985 | B1 | * | 4/2001 | Stephens | 246/120 |

FOREIGN PATENT DOCUMENTS

| | | | | |
|---|---|---|---|---|
| DE | 41 36 812 A1 | | 5/1993 | |
| JP | 362081556 A | * | 4/1987 | G01N/27/20 |
| JP | 62 182649 | | 8/1987 | |
| JP | 07 071700 | | 3/1995 | |
| JP | 2000121740 A | * | 4/2000 | G01V/1/00 |

OTHER PUBLICATIONS

R.B. Francini et al.: *Final Report, Real–Time Monitoring to Detect Third–Party Damage*, Gas Research Institute, Mar. 1996.

R.B. Francini et al.: *Final Report, Real–Time Monitoring to Detect Third–Party Damage: Phase II*, Gas Research Institute, Apr. 1997.

* cited by examiner

*Primary Examiner*—Benjamin C. Lee
(74) *Attorney, Agent, or Firm*—Mark E. Fejer

(57) ABSTRACT

A method for monitoring an in-ground pipeline by detecting an occurrence of a contact with an in-ground pipeline via an acoustic sensor employing a first selected detection parameter and a second sensor employing a second selected detection parameter, which is different from the first selected detection parameter. The locations of the acoustic sensor and the second sensor are known and the input signals from the sensors arrive at a processor at different times and at known respective speeds such as to permit a determination of the point of contact with the in-ground pipeline.

9 Claims, 2 Drawing Sheets

IN-GROUND PIPELINE MONITORING

BACKGROUND OF THE INVENTION

This invention relates generally to the monitoring of pipelines and, more particularly, to the monitoring of an in-ground pipeline for contact therewith.

In-ground pipelines have found various uses. For example and without unnecessary limitation, in-ground pipelines are used extensively in the transmission of various materials between selected points or locations. Natural gas is one example of a material frequently transmitted via in-ground pipelines.

It is known that damage to in-ground pipelines can occur directly as a result of acts of nature such as earthquakes and landslides, for example. The damage resulting to in-ground pipelines as a result of the occurrence of such acts typically occurs on a sufficiently large scale such that multiple pipe joints are affected and detection of the occurrence of such damage is relatively easy. Pipeline damage can, however, occur due to the act of a third party, i.e., a party other than the owner or operator of the pipeline. Such damage is known as "third-party damage." When the damage due to an act of a third party causes an immediate rupture of a pipe, little can be done via on-line monitoring to prevent an ensuing incident. However, many third-party contacts with pipelines can cause damage that does not result in an immediate pipeline failure but rather cause damage that may, with time, lead to a pipe failure such as in the form of a leak or a catastrophic rupture. For example, time and pressure cycling to which a pipeline might normally be subjected may, with time, eventually lead to the occurrence of such a pipeline failure, with such a pipeline failure sometimes referred to as a "delayed failure." In view of the above, the occurrence of such third-party contact and the effective detection thereof has proven to be a persistent problem While sounds associated with contact with a pipeline can be transmitted through the pipeline and detected at substantial distances from the point of contact via highly sensitive acoustic sensors, the high sensitivity of such sensors can produce or result in a significant number of false calls arising from sources other than by contact with the pipeline. For example, sources such as passing vehicles and weather conditions such as thunder and rain can produce or result in false calls to a normal sound detection and monitoring method and system.

In view of the consequences of the failure of an in-ground pipeline due to third-party contact, particularly when coupled with the extensive construction related with urban expansion and encroachment of the right-of-way commonly associated with many of such in-ground pipelines, there is a need and a demand for a method and system for monitoring in-ground pipelines and, in particular, detecting contact with a pipeline and proactively warn of the potential for the occurrence of damage associated therewith. In particular, there is a need and a demand for a monitoring method and system that can effectively eliminate false calls such as may arise from at least certain noncontact events. Further, there is a need and a demand for a monitoring method and system that can facilitate the speedy and accurate identification of the location on an in-ground pipeline whereat such a contact has occurred.

SUMMARY OF THE INVENTION

A general object of the invention is to provide an improved method and system for monitoring an in-ground pipeline.

A more specific objective of the invention is to overcome one or more of the problems described above.

The general object of the invention can be attained, at least in part, through a specified method for monitoring an in-ground pipeline. In accordance with one preferred embodiment of the invention, such a method involves detecting an occurrence of a contact with an in-ground pipeline via an acoustic sensor employing a first selected detection parameter and a second sensor employing a second selected detection parameter which is selected detection parameter is different. The acoustic sensor and the second sensor each transmits a corresponding input signal to a processor whereat the input signals are appropriately processed to determine the point of contact with the in-ground pipeline.

In a specific form of such method, the acoustic sensor is at a first known location relative to the in-ground pipeline, in contact with the in-ground pipeline, and transmits a corresponding first input signal to a processor. The second sensor is at a second known location relative to the in-ground pipeline. The second sensor employs a second selected detection parameter and transmits a corresponding second input signal to the processor. The second selected detection parameter is different from the first selected detection parameter and the first and second input signals arrive at the processor at different times and at known respective speeds.

The prior art has generally failed to provide a method and system for the monitoring of an in-ground pipeline in a manner as effective as desired. In particular, the prior art has generally failed to provide a method and system for the monitoring of an in-ground pipeline in a sufficiently unintrusive and effective manner such as to permit the reliable detection of contact with the pipeline and proactively warn of the potential for the occurrence of damage associated with such contact.

The invention further comprehends a method for identifying a location at which an in-ground pipeline has been subject to a contact. In accordance with one preferred embodiment of the invention, such a method involves:

- detecting an occurrence of a contact with the in-ground pipeline via an acoustic sensor at a known location relative to the in-ground pipeline, the acoustic sensor in contact with the in-ground pipeline and transmitting a corresponding first input signal to a processor;
- detecting the occurrence of the contact with the in-ground pipeline via an impressed current sensor, the impressed current sensor at a location proximate to the known location of the acoustic sensor, the impressed current sensor transmitting a corresponding second input signal to the processor, wherein the first and second input signals arrive at the processor at different times and at known respective speeds; and
- processing the first and second input signals in the processor to determine the location of the contact with the in-ground pipeline.

Other objects and advantages will be apparent to those skilled in the art from the following detailed description taken in conjunction with the appended claims and drawings.

DETAILED DESCRIPTION OF THE INVENTION

The present invention provides an improved method and system for the monitoring of an in-ground pipeline and the use thereof, such as for the detection of contact, e.g., third-party contact, with such an in-ground pipeline. As detailed below, the monitoring method and system of the invention is particularly helpful and effective in minimizing or avoiding the occurrence of false signals such as may result from at least certain noncontact events with the pipeline of interest.

Figure 1:
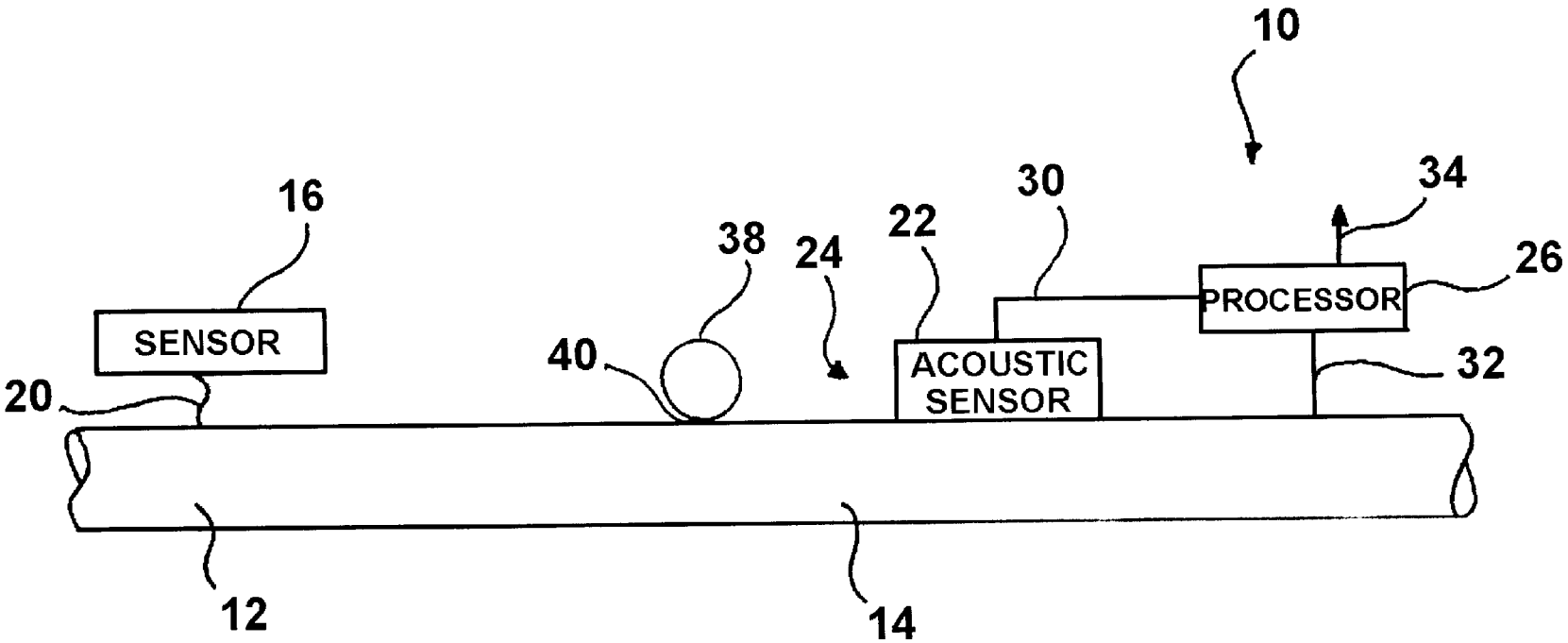
FIG. 1 a simplified schematic of an in-ground pipeline having a system for the monitoring thereof in accordance with one preferred embodiment of the invention.

The present invention may be embodied in a variety of structures and be practiced in a variety of manners. As representative, FIG. 1 illustrates the present invention as embodied in a system, generally designated by the reference numeral 10, in accordance with one preferred embodiment of the invention. As detailed below, the system 10 is effective for the monitoring of a pipeline 12, particularly a section or portion of the pipeline which is underground and which underground section or portion is herein designated by the reference numeral 14.

It will be understood that while the invention described hereinafter has general applicability to the monitoring of various in-ground pipelines, the invention is believed to at least initially have particular utility in the detection of contact, such as by a third party, for example, with a pipeline in the ground. Further, while the invention is generally applicable to such monitoring of in-ground pipelines, the invention is believed to at least initially have further particular utility for use in conjunction with those pipelines used for the transmission of a gaseous medium such as a natural gas stream, for example.

The pipeline section 14 is in-ground, e.g., below the ground surface. As identified above, a common concern and persistent problem relative to in-ground pipelines is the occurrence of third party contact with an in-ground pipeline. Of particular concern is the occurrence of such third party contact that may go unreported and such as, though not resulting in an immediate pipeline failure, may with time, result in a failure such as in the form of a leak or rupture.

A signal generator, rectifier or other suitable current impression device 16 is joined or otherwise effectively connected with the pipeline 12, such as represented by the line 20, to permit a desired current to be impressed on the pipeline 12 such as in a manner known in the art. In particular, it is known in the art to employ an impressed current in a pipeline to detect the occurrence or extent of corrosion of certain types of pipeline materials. For example and without unnecessarily limiting the broader practice of the invention, it is known to employ impressed currents for pipelines, such as those made of steel, in order to detect local holidays in the pipeline coating such as can result in the occurrence of corrosion of the pipeline.

The system 10 includes a first acoustic sensor 22, such as in the form of an accelerometer, in contact with pipeline section 14 at a location generally designated by the reference numeral 24. The first acoustic sensor 22 is in signal transmitting communication with a signal conditioning and processing unit 26, such as via a signal transmitting line 30.

As will be appreciated by those skilled in the art and guided by the teachings herein provided, various acoustic sensors such as capable of or useful in the detecting or monitoring of various or selected acoustic parameters such as relating to or resulting from pipeline vibrations are available and can, if desired, be used in the practice of the invention. For example, and without necessarily limiting the broader practice of the invention, acoustic sensors such as in the form of accelerometers, microphones or strain gauges can, if desired, be used. In view of the existence of substantial experience with the handling and use of accelerometers, the use of such devices may be preferred.

The system 10 also includes an impressed current sensor such as in the form of a current pick-up line 32 or other suitable sensor at, adjacent or otherwise proximate to the general pipeline location 24 of the first acoustic sensor 22 such as to detect the presence of current at such pipeline location. The current pick-up line 32 is also in signal transmitting communication with the signal conditioning and processing unit 26.

At the signal conditioning and processing unit 26, the signals received from the first acoustic sensor 22 and the impressed current sensor 32 can, if desired be appropriately conditioned such as by transduction into an appropriate voltage and, if desired, amplified. It is to be understood, however, that the broader practice of the invention is not necessarily limited to the use or incorporation of such signal conditioning.

The signals received from the first acoustic sensor 22 and the impressed current sensor 32, either directly or appropriately conditioned, are then appropriately processed such as via one or more processing analysis or technique in the unit 26, such as in the manner described in greater detail below, to produce or form an appropriate corresponding signal, designated by the reference numeral 34. The signal 34 can then be used such as by being transformed or otherwise appropriately conveyed such as in a manner known in the art to provide a warning or alert of contact with the pipeline 12 and the possibility of damage associated therewith. For example, such a signal can be processed to set off an alarm or other warning or signal of such contact.

As show in FIG. 1, the pipeline section 14 has for purposes of illustration and discussion been subjected to a contact as signified by the item designated by the reference numeral 38 at a location designated by the reference numeral 40. Those skilled in the art and guided by the teachings herein provided will appreciate that the contact 38 will be sensed by both the first acoustic sensor 22 and the impressed current sensor 32 and appropriate corresponding signals transmitted to the signal conditioning and processing unit 26. The input signal from the acoustic sensor and the input signal from the impressed current sensor arrive at the processor at different times and at known respective speeds such as to permit a determination of the location of the contact with the in-ground gas transmission pipeline. In particular, since each of these signals has originated from the same source at the same time, the difference in arrival time of the signals is a direct measure of the distance to the signal source. For example, the distance to the signal source can be determined using the following equation (1):

$$d = \left(\frac{v_1 v_2}{v_2 - v_1}\right) t_1 t_2 \tag{1}$$

where:

d=distance to the signal source, e.g., point of contact;

$v_1$=speed of the first sensor signal;

$v_2$=speed of the second sensor signal;

$t_1$=arrival time of the signal from the first sensor; and $t_2$=arrival time of the signal from the second sensor.

While all of the elements or components shown in FIG. 1 can, if desired be underground, in accordance with one embodiment of the invention, at least the pipeline section 14, the first acoustic sensor 22 and a part or all of the contact 38 are positioned, located or occur underground.

Figure 2:
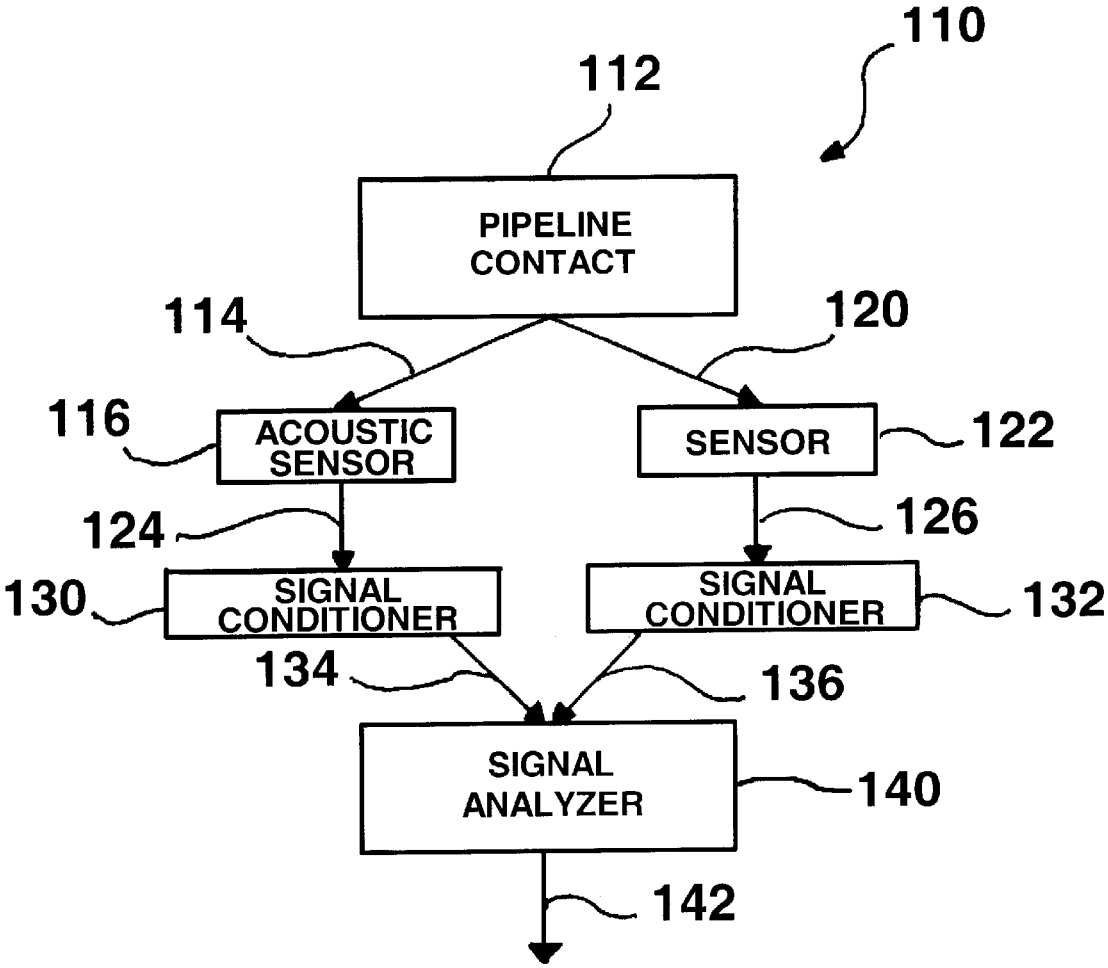
FIG. 2 is a simplified block diagram showing the monitoring of an in-ground pipeline in accordance with one preferred embodiment of the invention.

Turning now to FIG. 2, there is illustrated a simplified block diagram processing schematic, generally designated 110, showing the monitoring of an in-ground pipeline in accordance with one preferred embodiment of the invention. In accordance with the processing schematic 110, a contact with a pipeline, represented by the box 112, is sensed, as represented by the line 114, at or by a first in-ground acoustic sensor 116, such as in the form of an accelerometer, which is in contact with the pipe. The contact 112 is also sensed, as represented by the line 120, to or by a second sensor 122 such as in the form of an impressed current sensor.

A signal from each of the sensors 116 and 122, represented by the lines 124 and 126, respectively, can then, if desired and as shown, be forwarded or advanced to appropriate signal conditioners, as identified above, and here designated by the reference numeral 130 and 132, respectively. The signal conditioners 130 and 132 each then forward an appropriately conditioned signal 134 and 136, respectively to signal analysis 140, such as described above and such as in a processor.

As a result of the signal analysis 140, an output signal 142 is formed or produced. In particular, when and if the warning conditions of the signal processing analysis are satisfied, then such output signal 142 may constitute such a warning being issued or other appropriate signal being sent.

While the invention has been described above making specific reference to an embodiment wherein the second sensor for the detecting of the occurrence of the contact with the in-ground pipeline is in the form of an impressed current sensor, it will be understood by those skilled in the art that the broader practice of the invention is not necessarily so limited. For example, other forms or types of sensors may, if desired, be used in the practice of the invention provided that: the detection parameter of the second sensor is different from the detection parameter of the associated acoustic sensor, and the input signals from the second sensor and the associated acoustic sensor arrive at the processor at different times and at known respective speeds. For example, rather than relying on the detection of an interruption in a current impressed on a pipeline, the invention can be practiced employing a fiber optic line through which an appropriate signal is transmitted adjacent to the pipeline. In such a system, an interruption in the fiber optic signal rather than an interruption in an impressed current can be used in association with an appropriate acoustic signal, such as described above, to permit determination of the point of contact with the in-ground pipeline.

In addition, it will be appreciated that through the inclusion of a second sensor for the detection of the occurrence of a pipeline contact, the invention will generally result in enhanced reliability in the proper detection of the occurrence of such a pipeline contact.

While the invention has been described above as having particular utility in conjunction with the monitoring of in-ground pipelines such convey or transmit a gaseous medium such as a natural gas stream, it will be understood by those skilled in the art and guided by the teachings herein provided that the broader practice of the invention is not necessarily so limited. For example, if desired, the invention can be practiced in conjunction with a pipeline which conveys or transmits a material such as having a different selected fluid form such as a liquid, for example.

Thus, the invention provides a method and system for the monitoring of an in-ground pipeline in a more effective manner than otherwise previously known or disclosed. In particular, the invention provides a method and system for the monitoring of an in-ground pipeline such as to permit the detection of contact with the pipeline and proactively warn of the potential for the occurrence of damage associated with such contact, which method and system can operate in a manner which is both more unintrusive and effective than previously available.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for monitoring an in-ground pipeline, the method comprising:

detecting an occurrence of a contact with an in-ground pipeline via an acoustic sensor employing a first selected detection parameter, the acoustic sensor at a first known location relative to the in-ground pipeline and in contact with the in-ground pipeline, the acoustic sensor transmitting a corresponding first input signal to a processor;

detecting the occurrence of the contact with the in-ground pipeline via a second sensor, the second sensor at a second known location relative to the in-ground pipeline, the second sensor employing a second selected detection parameter and transmitting a corresponding second input signal to the processor, wherein the second selected detection parameter is different from the first selected detection parameter and the first and second input signals arrive at the processor at different times and at known respective speeds; and processing the first and second input signals in the processor to determine the point of contact with the in-ground pipeline.

2. The method of claim 1 wherein the first known location and the second known location are proximate to each other.

3. The method of claim 1 wherein the acoustic sensor is an accelerometer.

4. The method of claim 1 wherein the second sensor is an impressed current sensor.

5. The method of claim 1 wherein the in-ground pipeline transmits a gaseous medium.

6. The method of claim 5 wherein the in-ground pipeline transmits a natural gas stream.

7. A method for identifying a location at which an in-ground pipeline has been subject to a contact, the method comprising:

detecting an occurrence of a contact with the in-ground pipeline via an acoustic sensor at a known location relative to the in-ground pipeline, the acoustic sensor in contact with the in-ground pipeline and transmitting a corresponding first input signal to a processor;

detecting the occurrence of the contact with the in-ground pipeline via an impressed current sensor, the impressed current sensor at a location proximate to the known location of the acoustic sensor, the impressed current sensor transmitting a corresponding second input signal to the processor, wherein the first and second input signals arrive at the processor at different times and at known respective speeds; and processing the first and second input signals in the processor to determine the location of the contact with the in-ground pipeline.

8. The method of claim 7 wherein the in-ground pipeline transmits a gaseous medium.

9. The method of claim 8 wherein the in-ground pipeline transmits a natural gas stream.

* * * * *